US005944450A

United States Patent [19]

Anderson

[11] Patent Number: 5,944,450

[45] Date of Patent: Aug. 31, 1999

[54] INTEGRAL BUOYANCY AND BALLAST SYSTEM FOR SCUBA DIVERS

[75] Inventor: Steven R. Anderson, San Clemente, Calif.

[73] Assignee: Johnson Worldwide Associates, Sturetevant, Wis.

[21] Appl. No.: 08/706,425

[22] Filed: Aug. 30, 1996

[51] Int. Cl.[6] ..... B63C 11/30

[52] U.S. Cl. ..... 405/186; 441/106

[58] Field of Search ..... 405/185, 186, 405/187; 114/315; 441/106, 136

[56] References Cited

U.S. PATENT DOCUMENTS

| | | | |
|---|---|---|---|
| 2,982,105 | 5/1961 | Akers | 405/186 |
| 3,135,098 | 6/1964 | Root | 405/186 |
| 3,263,432 | 8/1966 | Maskell | 405/186 |
| 3,670,509 | 6/1972 | Walters | 405/186 |
| 3,842,611 | 10/1974 | Anderson | 405/186 |
| 3,877,098 | 4/1975 | Braly | 405/186 |
| 3,964,266 | 6/1976 | Bartlett | 405/186 |
| 4,016,616 | 4/1977 | Walters | 405/186 |
| 4,054,132 | 10/1977 | Deeds | 128/202.14 |
| 4,440,525 | 4/1984 | Perla | 405/186 |
| 4,608,940 | 9/1986 | Bulin | 405/186 |
| 4,752,263 | 6/1988 | Pritchard et al. | 114/88 |
| 4,778,307 | 10/1988 | Faulconer | 405/186 |
| 4,779,554 | 10/1988 | Courtney | 114/315 |
| 4,843,998 | 7/1989 | Parker | 114/315 |
| 4,877,167 | 10/1989 | McNemar | 224/269 |
| 4,887,932 | 12/1989 | Toth | 405/186 |
| 5,011,334 | 4/1991 | Vorhauer | 405/186 |
| 5,074,714 | 12/1991 | Franco | 405/186 |
| 5,085,163 | 2/1992 | VanTassel et al. | 405/186 |
| 5,199,820 | 4/1993 | Nicklo | 405/186 |
| 5,205,672 | 4/1993 | Stinton | 405/186 |
| 5,311,833 | 5/1994 | VanTassel et al. | 114/315 |
| 5,346,419 | 9/1994 | Kaiser | 441/96 |
| 5,496,136 | 3/1996 | Egan | 405/186 |
| 5,641,247 | 6/1997 | Seligman | 405/186 |

FOREIGN PATENT DOCUMENTS

| | | |
|---|---|---|
| 2259010 | 2/1972 | France . |
| 2590540 | 5/1987 | France . |
| 964217 | 7/1962 | United Kingdom . |

OTHER PUBLICATIONS

*1995 Zeagle* Catalog; 16 pages;entitled "Dive Without a Weight Belt".

Zeagle Systems, Inc. Excerpts of 1992 Catalog; 2 pages.

Zeagle Systems, Inc. 1994 Catalog; 16 pages.

*Primary Examiner*—Tamara L. Graysay
*Assistant Examiner*—Tara L. Mayo
*Attorney, Agent, or Firm*—Foley & Lardner

[57] ABSTRACT

A buoyancy compensator for a scuba diver vest having a pocket on each side of the front of the vest, a weight module removably positioned in each pocket, each weight module includes an envelope releasably mounted in said pocket a weight packet carried within the envelope, a weight removably mounted in said envelope, a strap operatively connected to the envelope and releasably connected to the vest. The weight is dropped from the weight packet by pulling the weight packet from the pocket and the envelope is returned to the pocket by a pair of elastic bands.

26 Claims, 5 Drawing Sheets

FIG. 1
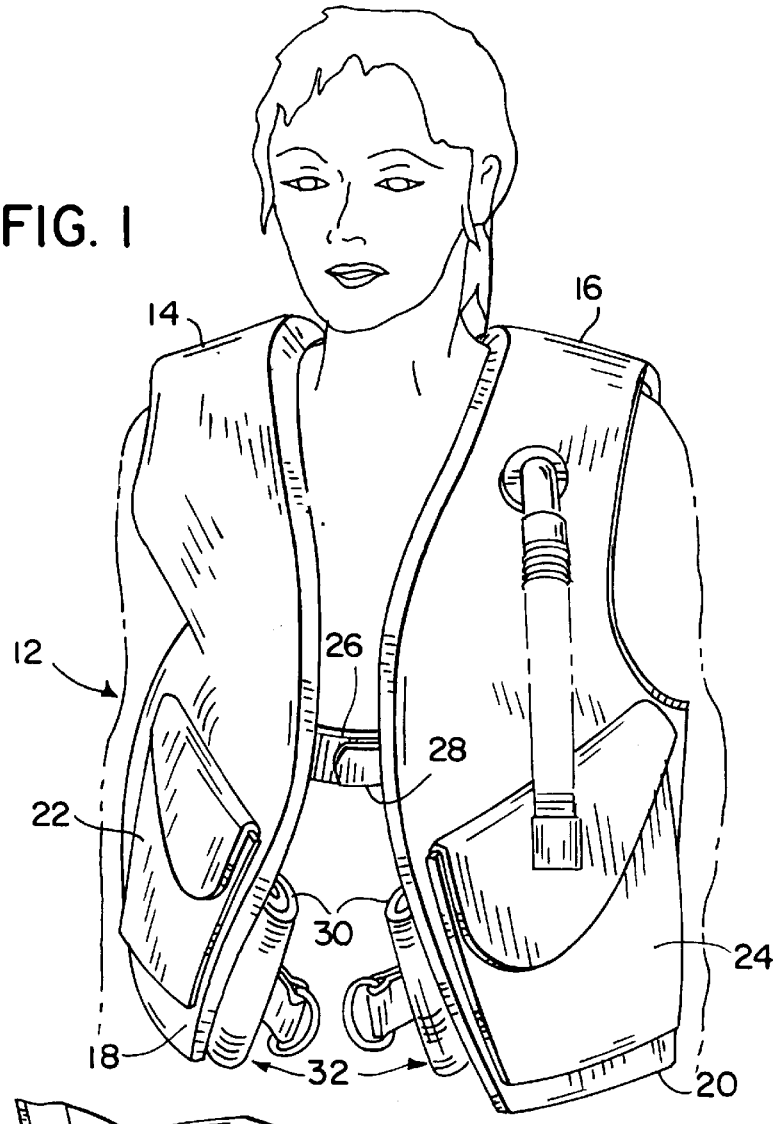
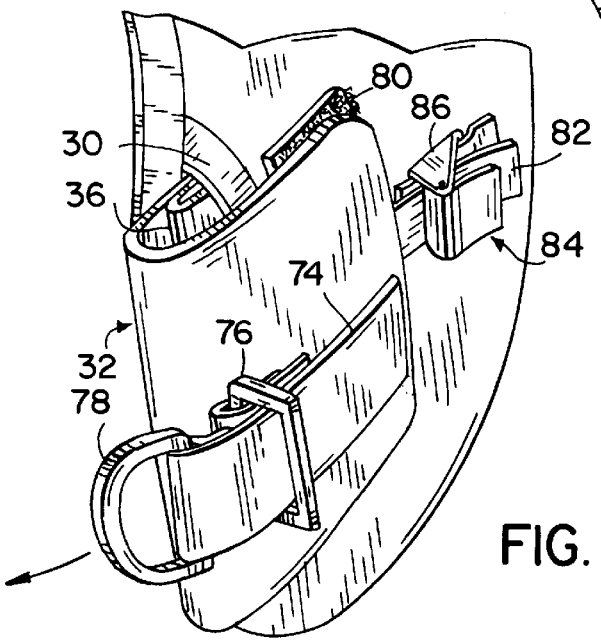
FIG. 2

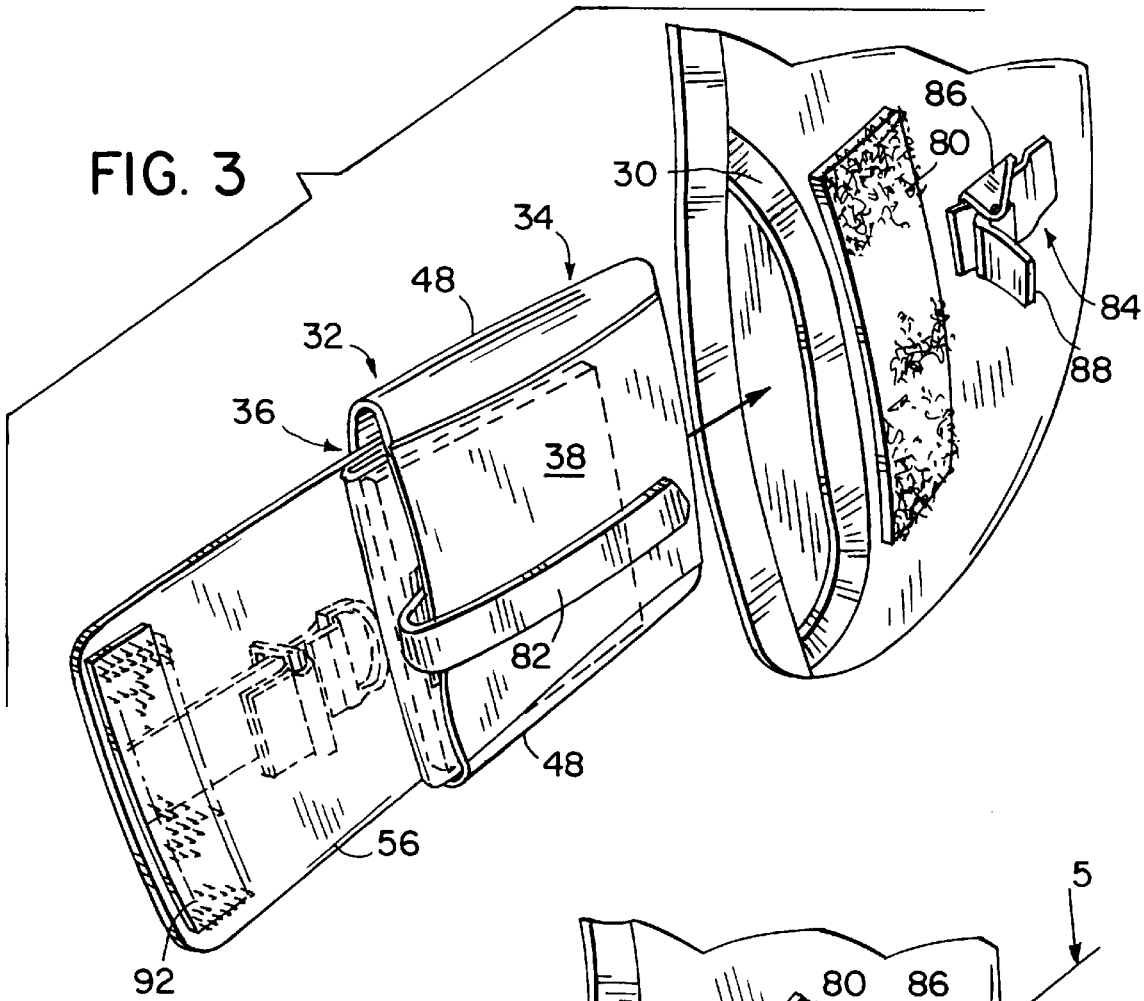
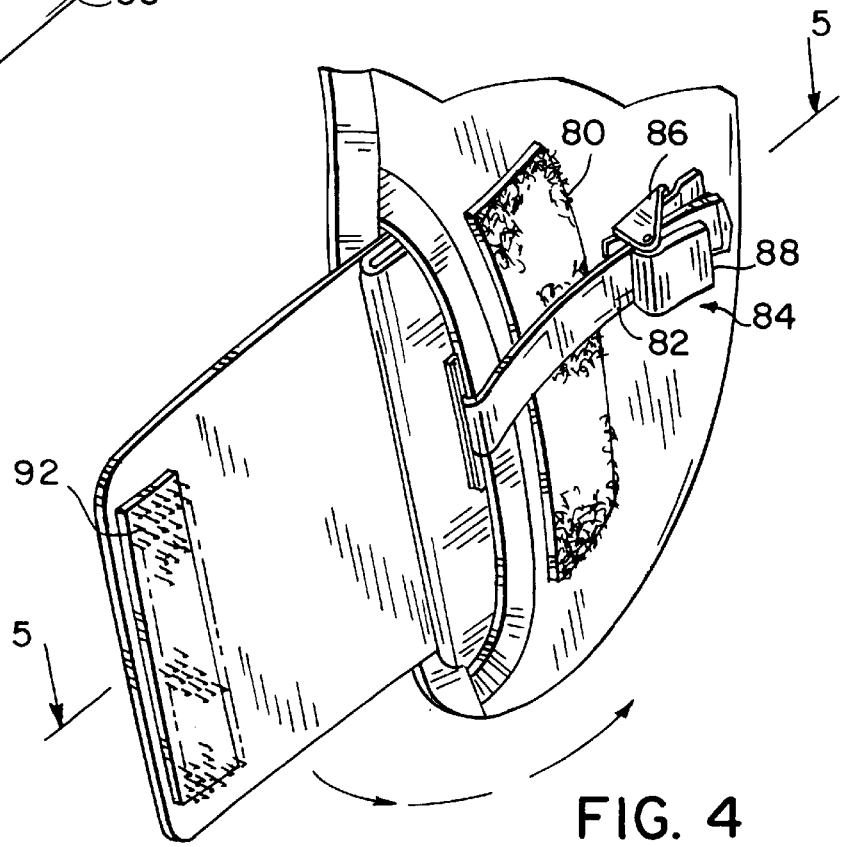
FIG. 4

INTEGRAL BUOYANCY AND BALLAST SYSTEM FOR SCUBA DIVERS

FIELD OF THE INVENTION

The present invention relates generally to scuba diving equipment and more specifically to a buoyancy compensating vest having quick release weight assemblies formed in the front panels of the vest.

BACKGROUND OF THE INVENTION

When scuba diving a diver must add negative weight ballast to his body and/or equipment in order to descend below the surface of the water. The prior art form of negative ballast is normally a waist-worn weight belt. This weight belt is usually left on the diver's waist from the time he enters and exits the water. The weight belt adds a significant amount of dead weight to the diving equipment. This dead weight makes it difficult for a diver to exit the water and climb back into a boat while ocean diving. The one piece waist-worn weight belts are generally too heavy and awkward to remove and install in the water. It takes two hands to attach the weight belt around the waist. It is almost impossible to attach the belt while floating in the water. This prior art form also makes it difficult for a diver to stand and walk erect while beach diving or getting into the equipment on a pitching boat.

The traditional art form (waist-worn weight belts) also rub and bang against the diver's hips while making ascents and descents. This has a tendency to make diving uncomfortable. This art form also places the diver's body in tension because the weights are pulling them down from the waist while the buoyancy compensator is lifting him up from the shoulders and upper torso. This may cause undue muscle fatigue.

There are many different types of tank mounted weight ballast systems such as shown and described in U.S. Pat. No. 4,887,932, issued to Toth on Dec. 19, 1989, entitled "Integral Buoyancy And Ballast System For Scuba Divers," and U.S. Pat. No. 5,011,334, issued to Vorhauer on Apr. 30, 1991, entitled "Buoyancy Compensator With Interchangeable Accessories."

SUMMARY OF THE PRESENT INVENTION

In accordance with the present invention there is provided a scuba tank stabilizing/weight frame. The weight frame straps onto the external surface of a conventional scuba tank which provides an attachment point for two separate weight ballast modules. The weight modules are adjustable for ballast weight to suit individual diving requirements. The weight modules can be removed and reattached by the diver while on land or in the water. The weight modules are positioned such that they counterbalance the weight of the scuba tank such that a diver can stand and walk erect while on land or in a boat. Furthermore, while in water the weight modules are positioned such that they provide the diver with negative ballast that is below his center of gravity (while swimming horizontally) which makes him more stable in the water.

The invention features a quick disconnect coupling that provides two different and separate mechanical methods to release the weight modules. An additional advantage of the present invention is to provide weight ballast modules that can be released from any position, to provide two separate, independent ballast release mechanisms that are visible and readily accessible to the diver, to provide the diver with the option to release one-half of the ballast weight to make a slower and safer emergency ascent and to provide weight ballast modules that can be attached or released from a supporting frame by one hand. In this regard it should be noted that the weights are released by using the right hand to release the left weight and the left hand to release the right weight.

Other principal features and advantages of the invention will become apparent to those skilled in the art upon review of the following drawings, the detailed description and the appended claims.

BRIEF DESCRIPTION OF THE DRAWINGS

FIG. 1 is a perspective view of the buoyancy compensating device shown mounted on the body of the user;

FIG. 2 is a perspective view of the weight release mechanism;

FIG. 3 is a perspective view of the weight release mechanism aligned with the pocket in the vest;

FIG. 4 is a view similar to FIG. 3 showing the weight inserted into the pocket;

Figure 5:
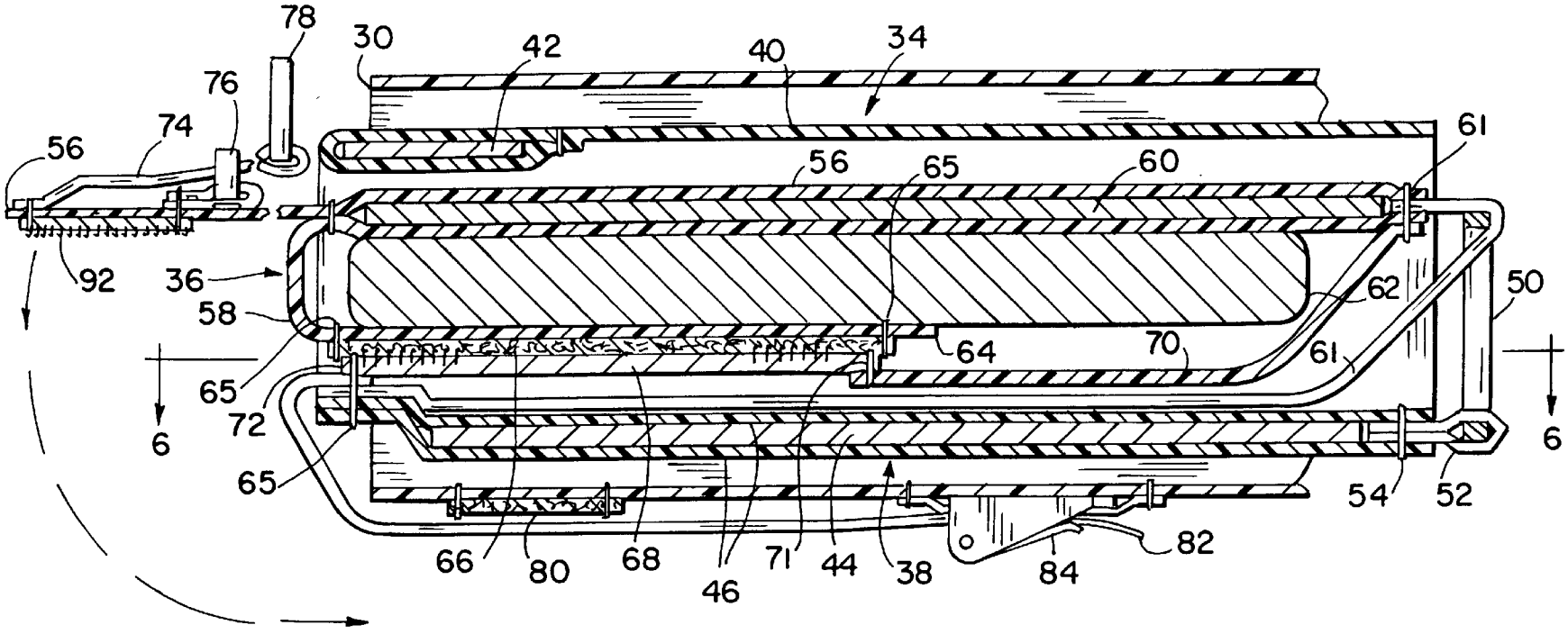
FIG. 5 is a view taken on line 5—5 of FIG. 4.
Figure 6:
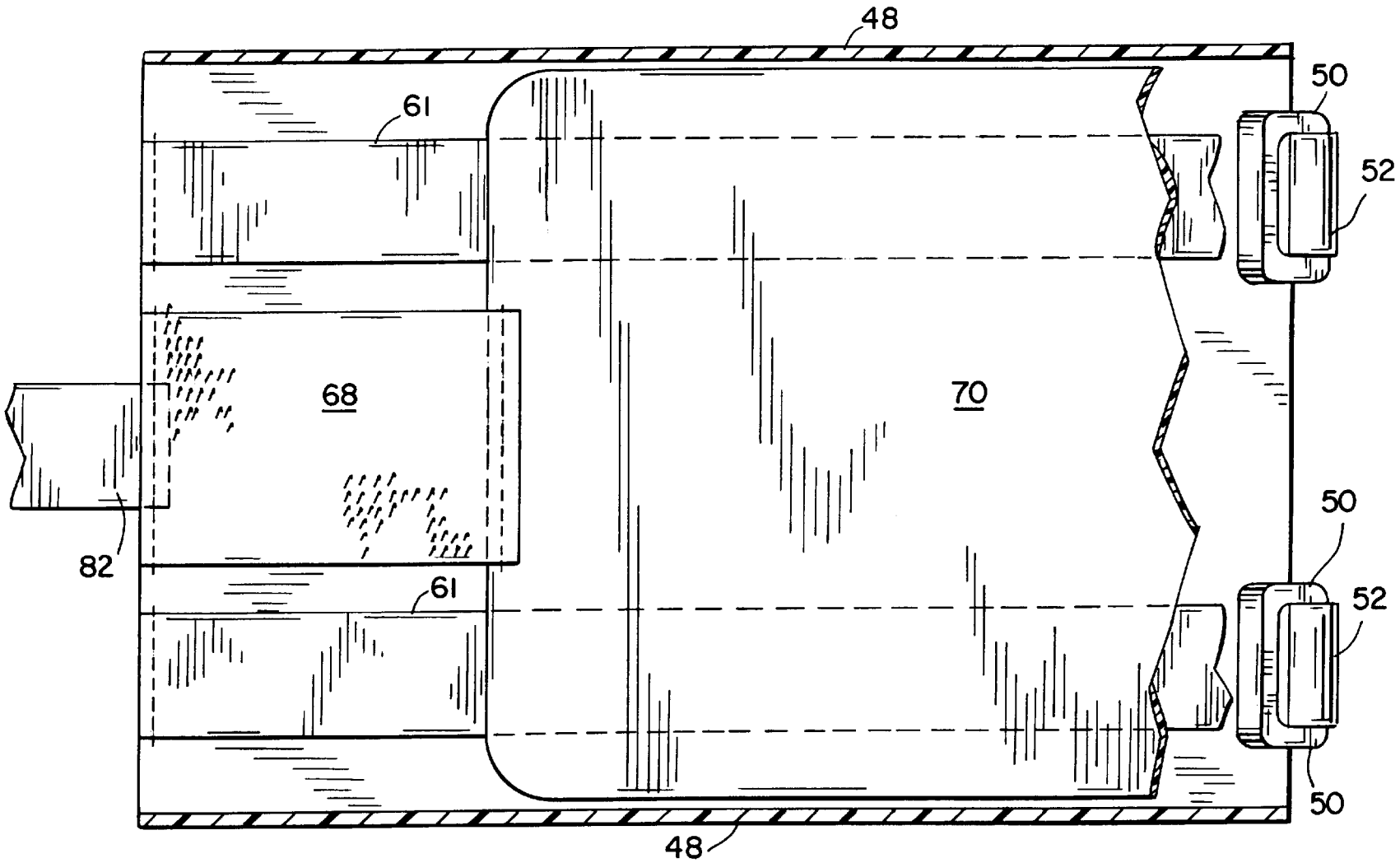
FIG. 6 is a view taken on line 6—6 of FIG. 5.

Before explaining at least one embodiment of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION OF THE PREFERRED EMBODIMENTS

The buoyancy compensator according to the present invention relates to a vest 12 shown mounted on the shoulders of a scuba diver. The vest generally includes a right shoulder strap 14 and a left shoulder strap 16, a right front panel 18 and a left front panel 20. Pockets 22 and 24 are provided on the outside of the panels 18 and 20, respectively. The panels 18 and 20 are connected by hook and loop straps 26 and 28, respectively. A weight pocket 30 is provided on the inside of each of the front panels 18 and 20. Weight modules 32 are shown aligned with the pockets 30. It should be noted that the modules 32 are symmetrical and therefore capable of being inserted in either of the pockets 30 provided in the inside of the vest 12.

Referring to FIGS. 3, 4 and 5, the weight modules 32 generally include an envelope 34 and a weight packet 36. The envelope 34 has a front panel assembly 38 and a back panel 40. A plastic strip 42 is enclosed in the front of the back panel 40. The front panel assembly 38 includes a plastic panel 44 enclosed by a pair of panels 46. The edges of the panels 40 and 46 are joined at the top and bottom by an elastic strap 48. A pair of rectangular plastic loops 50 are pivotally connected to the straps 52 which are secured to the panels 46 by pins 54.

The weight packet 36, as shown in FIG. 5, includes an outer panel 56 and an inner panel 58 and a plastic panel 60 enclosed by panels 56 and 58. The panels 56 and 58 are joined at the inner end to an elastic band 61 which is wrapped around the inner side of the plastic loop 50 and attached to the inner ends of panels 56 and 58 by clips 61.

The outer end 64 of the inner panel 58 is retained in the envelope by a loop strip 66 mounted on the end of the panel 58 by clips 65. A hook strip 68 is connected at one end to a panel 70 by clips 71. The other end 72 is connected to the end of assembly 38 by clip 65, as shown in FIG. 5.

Figure 7:
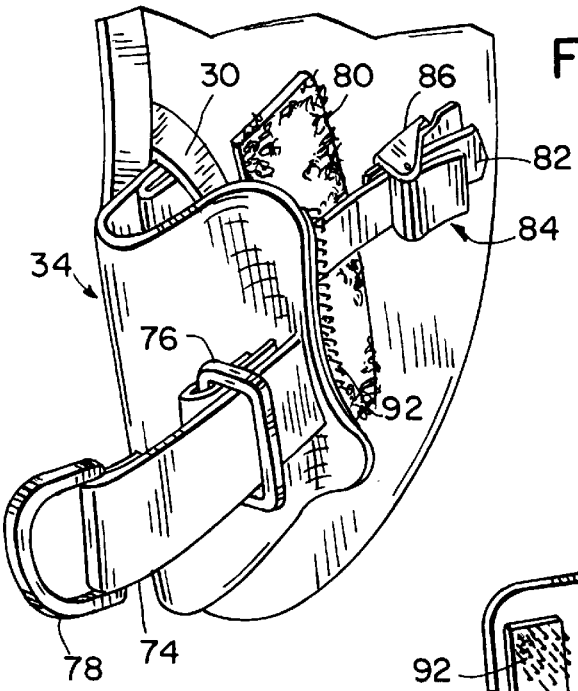
FIG. 7 is a perspective view of the weight release pocket.
Figure 8:
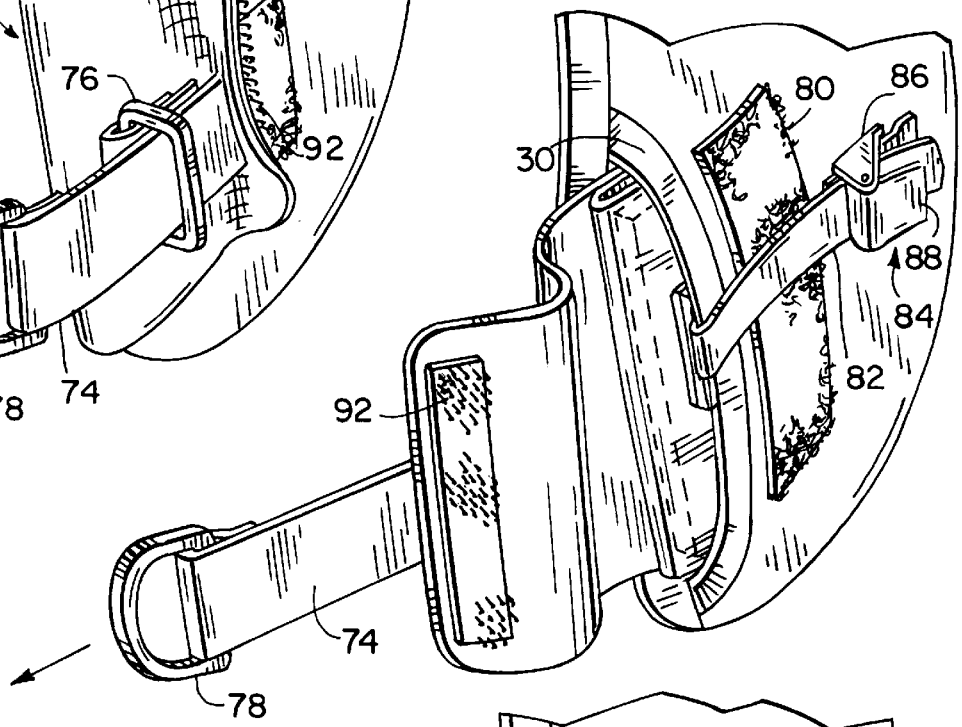
FIG. 8 is a perspective view showing the release of the flap from the pocket.
Figure 9:
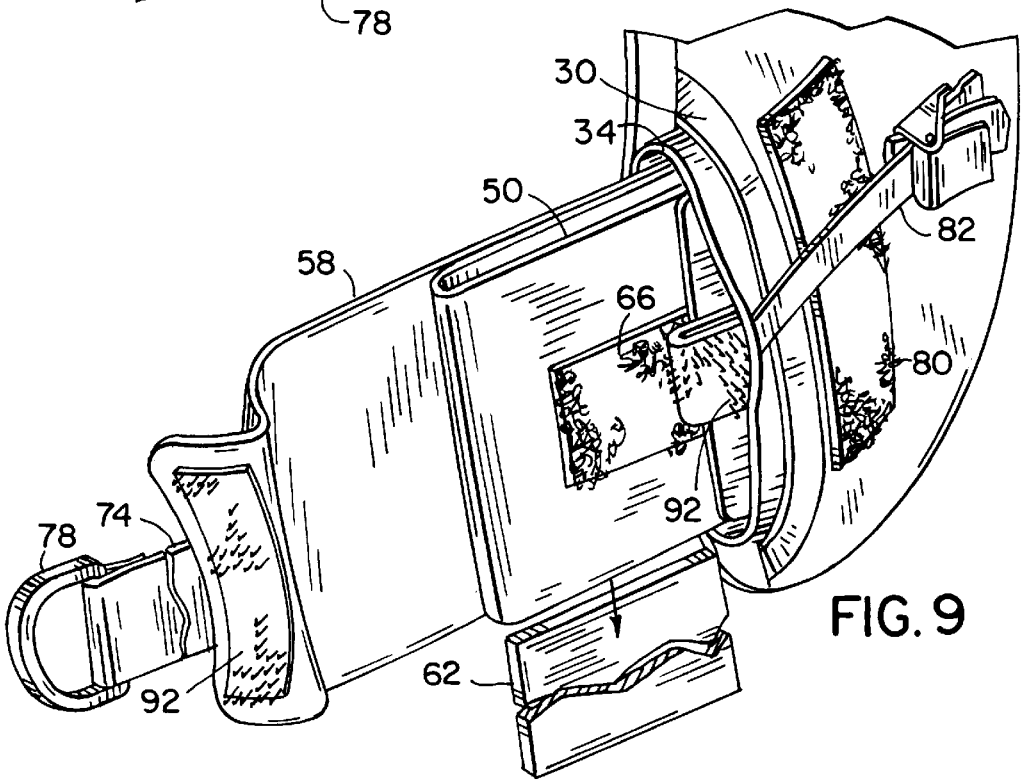
FIG. 9 is a perspective view of the pocket showing the weight released from the pocket.

A loop strip 80 is mounted on the inside of the vest adjacent to pocket 30. A release strap 82 is attached to the end of the panels 46 by the clip 65. The other end of the strap 82 is aligned in a clamp assembly 84 having a base plate 86 and an over-center clamp plate 88 pivotally mounted in the base plate 86 for clamping the end of the strap 82 to the base plate 86. The strap 82 causes the pocket 30 to roll back to release the hook panel 68 from the loop panel 66, as shown in FIGS. 7, 8 and 9.

Referring to FIG. 5, the envelope 34 is shown inserted into the pocket 30 with the release strap 74 aligned with the clamp assembly 84. The panel 56 is folded over the loop strip 80 to attach the hook strip 92 to the loop strip 80. The release strap 74 is attached to the outer end of the panel 56 and is passed through a guide ring 76 which is secured to the panel 56 a spaced distance from the edge of the panel. The weight 62 is released from the pocket 30 by pulling ring 78, as shown in FIG. 7, through guide 76 to release the hook strip 92 from the loop strip 80. As the pocket formed by the inner panel 60 moves outward, the loop strip 66 is released from the hook strip 68. The weight 62 is moved outwardly until it clears the pocket to allow the weight to drop out of the pocket.

Thus, it should be apparent that there has been provided in accordance with the present invention an integral buoyancy and ballast system for scuba divers that fully satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. A selectively releasable weight assembly for use by scuba divers in conjunction with a buoyancy vest having a weight pocket, said assembly comprising:

a weight packet carried within the pocket and configured for releasibly engaging a weight within the pocket such that removal of the packet out of the pocket causes the weight to drop out of the packet;

means for retaining the packet in the pocket; and means for pulling the packet out of the pocket.

2. The weight assembly according to claim 1 wherein said retaining means includes a pair of elastic bands operatively connected to the packet to bias the packet into the pocket.

3. The weight assembly according to claim 2 wherein the packet includes a first and a second panel, each panel having an outer end operatively connected to said elastic bands, the outer end of the first panel being wrapped around said weight and the outer end of the second panel being wrapped around the outside of the pocket.

4. The weight assembly according to claim 3 including a first hook and loop assembly for releasably retaining the outer end of the first panel around the weight.

5. The weight assembly according to claim 4 including a second hook and loop assembly for releasably retaining the outer end of the second panel to the pocket.

6. The weight assembly according to claim 5 including means operatively connected to the edge of the packet for releasing the first hook assembly from the first loop assembly to release the first panel from the pocket.

7. The weight assembly according to claim 6 including a pull ring mounted on the outer end of the second panel for releasing the second hook assembly from the second hoop assembly.

8. A weight removal system for use with a buoyancy garment including a weight pocket carrying a weight and having an opening, the system comprising:

a moveable weight engaging member configured for being secured within the pocket in engagement with the weight, wherein the engaging member is moveable from a retracted position to an extended position during which the engaging member moves toward the opening to move the weight out of the pocket and while remaining coupled to the pocket.

9. The system of claim 8, wherein the weight engaging member is biased towards the retracted position.

10. The system of claim 9, wherein the engaging member is resiliently biased towards the retracted position by an elastic member.

11. The system of claim 8, wherein the engaging member is configured for engaging first and second opposite sides of the weight to move the weight from the pocket during movement of the engaging member from the retracted position to the extended position and to move the weight into the pocket during movement of the engaging member from the extended position.

12. The system of claim 11, wherein the engaging member is configured for substantially encircling the weight and wherein the engaging member includes an opening through which the weight is released.

13. The system of claim 8, including an envelope configured for being releasibly secured to the garment within the pocket, the envelope having a cavity for containing the weight and an opening proximate to the opening of the pocket, wherein the weight engaging member is secured to the envelope within the cavity.

14. The system of claim 13, wherein the engaging member is releasably attached within the envelope by a hook and loop fastener coupled therebetween.

15. The system of claim 14, wherein the envelope is releasibly secured to the garment by a strap coupled to the envelope and by a clamp assembly secured to the garment.

16. The system of claim 8, including an extension coupled to the engaging member and extending beyond the pocket for moving the engaging member towards the extended position.

17. The system of claim 8, wherein the engaging member is releasibly coupled to the buoyancy garment by a hook and loop fastener coupled therebetween.

18. A weight removal system for use with a buoyancy garment, the system comprising:

an envelope configured for being releasibly attached to the garment, the envelope having a cavity for receiving a weight and an opening through which the weight may be moved from the envelope while the envelope remains attached to the buoyancy garment.

19. The system of claim 18, wherein the buoyancy garment includes a weight pocket and wherein the envelope is configured for being received within the weight pocket.

20. The system of claim 18, wherein the envelope is releasibly attached to the garment by a clamp coupled to the buoyancy garment.

21. The system of claim 18, wherein the envelope further includes a weight engaging member secured to the envelope within the cavity, the engaging member being moveable from a retracted position to an extended position during which the engaging member moves towards the opening to move the weight through the opening of the envelope and away from the engaging member.

22. The system of claim 21, wherein the weight engaging member is biased towards the retracted position.

23. The system of claim 22, wherein the engaging member is biased towards the retracted position.

24. The system of claim 21, wherein the engaging member is resiliently biased towards the retracted position by an elastic member.

25. The system of claim 21, wherein the engaging member is configured for engaging first and second opposite sides of the weight to move the weight from the cavity during movement of the engaging member from the retracted position to the extended position and to move the weight into the cavity during movement of the engaging member from the extended position to the retracted position.

26. The system of claim 21, wherein the engaging member is configured for substantially encircling the weight and wherein the engaging member includes an opening through which the weight is released.

* * * * *